US005629368A

United States Patent [19]

Chung

[11] Patent Number: 5,629,368

[45] Date of Patent: May 13, 1997

[54] LIQUID SLURRY OF BENTONITE

[75] Inventor: Daniel K. Chung, Burlington, Canada

[73] Assignee: Nalco Canada, Inc., Burlington, Canada

[21] Appl. No.: 443,043

[22] Filed: May 17, 1995

Related U.S. Application Data

[62] Division of Ser. No. 148,069, Nov. 4, 1993, Pat. No. 5,484,834.

[51] Int. Cl.[6] ..... C08K 3/34; C04B 33/04; C04B 41/68

[52] U.S. Cl. ..... 524/446; 524/447; 501/148; 106/487; 423/33.01; 427/344; 428/439

[58] Field of Search ..... 524/443, 446, 524/447; 106/487; 501/148; 423/330.1; 427/344; 428/439

[56] References Cited

U.S. PATENT DOCUMENTS

| | | | |
|---|---|---|---|
| 3,687,846 | 8/1972 | Lang | 524/447 |
| 3,838,047 | 9/1974 | Le Blanc | 524/447 |
| 4,554,307 | 11/1985 | Farrar et al. | 524/447 |
| 4,749,444 | 6/1988 | Lorz et al. | 162/168.3 |
| 4,753,710 | 6/1988 | Langley et al. | 162/169.3 |
| 4,795,531 | 1/1989 | Sofia et al. | 162/164.6 |
| 4,824,523 | 4/1989 | Wagberg et al. | 162/164.1 |
| 4,880,759 | 11/1989 | Kohut | 501/148 |
| 4,892,590 | 1/1990 | Gill et al. | 106/214 |
| 4,897,119 | 1/1990 | Clarke | 106/117 |
| 4,946,605 | 8/1990 | Farrar et al. | 252/8.514 |
| 5,126,014 | 6/1992 | Chung | 162/164.6 |
| 5,153,155 | 10/1992 | Kohut | 501/141 |
| 5,173,208 | 12/1992 | Chung et al. | 252/180 |

FOREIGN PATENT DOCUMENTS 0335575 10/1989 European Pat. Off. .

OTHER PUBLICATIONS

Product Bulletin No. TFA03 "Technifax—Performance Optimization of Dissolved Air Flotation Units Using Synthetic Polymers".

*Primary Examiner*—Paul R. Michl
*Assistant Examiner*—Olga Asinovsky
*Attorney, Agent, or Firm*—Robert A. Miller; James J. Drake; Patricia A. Charlier

[57] ABSTRACT

A process for preparing a liquid slurry of bentonite which comprises the steps of charging a reactor vessel with between about 25 to about 75% of water by weight. The water is heated to a temperature range between about 50° C. to about 95° C. The reactor vessel is charged with between about 0, 1 and about 10% of sodium salt of silicic acid by weight and with between about 15 to about 35% of bentonite by weight. The reactor vessel is also charged with between about 10 to about 30% of a polyacrylate by weight.

9 Claims, No Drawings

LIQUID SLURRY OF BENTONITE

This application is a division of application Ser. No. 08/148,069, filed Nov. 4, 1993, now U.S. Pat. No. 5,484,834.

A liquid slurry of bentonite which is generally useful as a retention and drainage aid in both papermaking and wastewater treatment processes. The liquid slurry of bentonite preferably comprises a bentonite present in an amount of between about 15 to about 35% by weight, water present in an amount between about 25 to about 75% by weight, a polyacrylate present in an amount of between about 10 to about 30% by weight, and sodium silicate (e.g., sodium salt of silicic acid) which is present in an amount of between about 0.1 to about 10% by weight.

BACKGROUND OF THE INVENTION

Much attention has been paid by the paper industry to chemically pre-treating cellulosic suspensions for the purpose of improving the retention and drainage properties thereof. For example, it is common to include various inorganic materials, such as bentonite and alum, and/or cationic organic materials, such as natural or modified natural or synthetic polymers, in the thin stock for the purpose of improving the papermaking process. These additives are used for pitch control, decoloration of the drainage water or for facilitating release from drying rolls. Starch is often included to improve strength.

As discussed in U.S. Pat. No. 4,753,710 (Langley et al.), which issued on Jun. 28, 1988, paper stocks may have both an inorganic additive and an organic polymeric material for the purpose of improving retention, drainage, drying and/or formation. For example, a stock may include bentonite, an aluminum sulfate coagulant, and a cationic polymer such as polyethylene imine to improve dewatering. Others have treated paper stock with a filler, a nonionic polyacrylamide, and bentonite. Still others have demonstrated that addition of either a cationic starch or cationic polyacrylamide and bentonite also improves retention. Another process which is believed to result in a suspension having good strength and satisfactory retention includes colloidal silicic acid and cationic starch additives.

In particular, U.S. Pat. No. 4,753,710 provides for the addition of an inorganic material such as bentonite after one of the shear stages, and an organic polymeric material such as a substantially linear, synthetic, cationic polymer (e.g., a cationic polymer flocculant) having a molecular weight above 500,000 and which is added to the suspension before the shear stage in an amount which is at least 0.03%, based on the dry weight of the suspension. It is also common to include a filler, such as calcium carbonate, clay, titanium dioxide or talc or a combination, in the cellulose suspension or paper stock. The filler is preferably incorporated into the stock before addition of the synthetic polymer.

The stock may include other additives such as rosin, alum, neutral sizes or optical brightening agents. It may also include a strengthening agent and this can be a starch, often a cationic starch. The pH of the stock is generally in the range of 4 to 9.

An improvement of U.S. Pat. No. 4,753,710 is disclosed in European Patent Publication No. 0 335 575 (Langley), which was published on Oct. 4, 1989. This patent application was directed primarily to newsprint and board, wherein a low molecular weight cationic polymer, e.g., polyethylene imine, polyamines, polycyandiamide formaldehyde polymers, amphoteric polymers, and polymers of monomers selected from diallyl dimethyl ammonium chloride, diallylaminoalkyl(meth) acrylates and dialkylaminoalkyl (meth) acrylamides, is added to the fiber suspension, followed by addition of a starch, followed by the addition of bentonite or colloidal silicic acid after the shear stage.

The chemical treatment program of a cationic coagulant/cationic flocculant/bentonite program disclosed in European Patent Publication No. 0 335 575 creates problems due to the handling of dry bentonite, a known carcinogen, which is extremely harmful. Therefore, it would be most desirable to develop alternatives to dry bentonite. The present inventor has developed a novel liquid slurry of bentonite which overcomes the problems associated with dry bentonite, i.e., health risks and effect of aging on swellability. The novel liquid slurry of bentonite is pumpable and is readily dispersed in aqueous solution with minimum mixing, i.e., no handling of the dry bentonite is required. Also, the performance of bentonite is closely related to its swellability (i.e., aging effect). The novel liquid slurry of bentonite produces a stabilized bentonite product without materially effecting its performance.

The present invention also provides many additional advantages which shall become apparent as described below.

SUMMARY OF THE INVENTION

A liquid slurry of bentonite which comprises a bentonite present in an amount of between about 15 to about 35% by weight, water present in an amount between about 25 to about 75% by weight, a polyacrylate present in an amount of between about 10 to about 30% by weight, and sodium silicate (e.g., sodium salt of silicic acid) which is present in an amount of between about 0.1 to about 10% by weight. Optionally, a condensate polymer of naphthalene sulfonate can be present in an amount of between about 10 to about 30% by weight in the place of the polyacrylate.

It is preferable that the polyacrylate be either a copolymer of acrylic acid and maleic acid, and salts thereof or a sodium polyacrylate. The polyacrylate preferably has a molecular weight in the range between about 5,000 to about 250,000.

Additionally, the present invention includes a process for preparing a liquid slurry of bentonite which comprises the steps of: charging a reactor vessel with water; heating the water to a temperature in the range between about 50° C. to about 95° C.; charging the reactor vessel with sodium salt of silicic acid; and charging the reactor vessel with bentonite.

Other and further objects, advantages and features of the present invention will be understood by reference to the following specification.

DESCRIPTION OF THE PREFERRED EMBODIMENTS

Paper is made by providing a thick stock, diluting the thick stock to form a thin stock, draining the thin stock to form a sheet and drying the sheet. The thick stock can be made either by mixing water into dried pulp or, in an integrated mill, by diluting a drained pulp. The initial stock can be made from any conventional papermaking stock such as traditional chemical pulps, for instance bleached and unbleached sulfate or sulfite pulp, mechanical pulps such as groundwood, thermomechanical or chemithermomechanical pulp, and any mixtures thereof.

The stock, and the final paper, can be substantially unfilled (e.g., containing less than 10% and generally less than 5% by weight filler in the final paper) or, as is preferred according to the present invention, filler can be provided in an amount of up to 50% based on the dry weight of the stock or up to 40% based on dry weight of paper. It is preferable that precipitated calcium carbonate (PCC) be used as the filler, although it is still possible that any other conventional filler such as clay, titanium dioxide or talc or a combination may be substituted therefore. The filler is typically incorporated into the stock before addition of the synthetic polymer.

The stock may include other additives such as rosin, alum, neutral sizes or optical brightening agents. It also includes a cationic starch strengthening agent.

The amounts of fiber, PCC filler, and cationic starch strengthening agent can all be conventional. Typically, the thin stock has a solids content of 0.2 to 3% or a fiber content of 0.1 to 2%. The stock preferably has a solids content of 0.3 to 1.5 or 2%.

The cationic starch can be derived from any of the commonly available sources of starch producing materials, such as potatoes, corn, wheat and rice. A potato derived starch is favored, especially one in which the degree of substitution is between 0.10% and 0.50%. The preferred cationic potato starch is one made cationic by reaction with 3-chloro-2-hydroxypropyl trimethylammonium chloride to a degree of substitution of from 0.20% to 0.40%.

The ratio of precipitated calcium carbonate to cationic starch ranges from about 2:1 to 1:20. On a dry weight basis, the amount of cationic starch to pulp can vary from about 0.5% to 1.5% dry weight of pulp. The preferred range is 1.0% to 1.5%.

In an actual papermaking operation the precipitated calcium carbonate would be added at the stuff box and the cationic starch would be added before the fan pump. However, total optimization would depend on the approach flow system associated with each specific papermaking machine.

The present invention is typically used in a process wherein fine paper is made by forming an aqueous cellulosic suspension comprising fibers, a precipitated calcium carbonate filler and a cationic starch strengthening agent, passing the suspension through one or more shear stages, draining the suspension to form a sheet and drying the sheet. The retention and drainage properties of the suspension can be substantially improved via the addition a cationic coagulant having a molecular weight in the range between about 2,000 to about 500,000 to the suspension prior to any of the shear stages, an anionic flocculant having a molecular weight of at least 500,000 and a degree of anionic substitution of at least 0.01 to the suspension after the low molecular weight coagulant but before any of the low molecular weight coagulant but before any of the shear stages, and an inorganic material selected from the group consisting of: bentonite, colloidal silica and any other inorganic microparticle material, to the suspension after at least one of the shear stages.

The filler is preferably precipitated $CaCO_3$, although other fillers such as clay, titanium dioxide or talc or a combination may also be substituted therefore. The strengthening agent is preferably a cationic starch.

The coagulant has a preferred molecular weight in the range between about 10,000 to about 500,000.

The coagulant is preferably added to a thick stock of the cellulosic suspension and the anionic flocculant is preferably added to a thin stock of the cellulosic suspension. The thin stock is a dilute aqueous suspension of the thick stock. It should be understood, however, that addition of the coagulant and flocculant at any time prior to the shearing stages would be contemplated hereunder.

The cationic coagulant is preferably added to the cellulosic suspension in an amount between about 0.001% to about 0.5%, based on the dry weight of the suspension. The anionic flocculant is preferably added to the cellulosic suspension in an amount between about 0.001 to about 0.8%, based on the dry weight of the suspension.

The coagulant is cationic and selected from the group consisting of: polyethylene imine, polyamines, polycyandiamide formaldehyde polymers, amphoteric polymers, diallyl dimethyl ammonium chloride polymers, diallylaminoalkyl (meth)acrylate polymers, and dialkylaminoalkyl(meth) acrylamide polymers, a copolymer of acrylamide and diallyl dimethyl ammonium chloride, a copolymer of acrylamide and diallyaminoalkyl(meth)acrylates, a copolymer of acrylamide and dialkylaminoalkyl(meth)acrylamides, and a polymer of dimethylamine epichlorohydrin.

The high molecular weight anionic flocculants are selected from the group consisting of: a copolymer of acrylic acid and acrylamide, and a copolymer of acrylamide and acrylamido-2-methyl propyl sulfonate.

The inorganic material is preferably bentonite or a colloidal silica which is added in an amount of from about 0.03 to about 1.0%, based on the dry weight of the suspension.

The pH of the cellulosic suspension is preferably in the range between about 6.8 to about 9.0, especially when calcium carbonate is used as a filler.

According to the present invention it is very advantageous to use a liquid slurry of bentonite as the inorganic material. The liquid slurry of bentonite which comprises: a bentonite present in an amount of between about 15 to about 35% by weight, water present in an amount between about 25 to about 75% by weight, a polyacrylate present in an amount of between about 10 to about 30% by weight, and sodium salt of silicic acid which is present in an amount of between about 0.1 to about 30% by weight.

Optionally, the liquid slurry of bentonite may also include between about 10 to about 30% by weight of sulfonate. The sulfonate is preferably a calcium naphthalene sulfonate condensate polymer.

The polyacrylate may be a copolymer of acrylic acid and maleic acid, and salts thereof, or a sodium polyacrylate. The polyacrylate preferably has a molecular weight in the range between about 5,000 to about 250,000, more preferably between about 8,000 to about 100,000, and most preferably between about 10,000 to about 100,000.

The bentonite is typically a chemically modified bentonite, although any dry particulate bentonite may be used in accordance with this invention.

The preferred process for forming the liquid slurry of bentonite according to this invention is by charging a reactor vessel with between about 25 to about 75% by weight of water; heating the water to a temperature in the range between about 50° C. to about 95° C.; charging the reactor vessel with between about 0.1 about 10% by weight of sodium salt of silicic acid; and charging the reactor vessel with between about 15 to about 35% by weight of bentonite.

Optionally, the liquid slurry of bentonite may comprise bentonite present in an amount of between about 30 to about 40% by weight, an inert liquid vehicle comprising a glycol which is present in an amount of between about 50 to about 70% by weight, and a suspension agent which is present in an amount of between about 0.5 to about 5% by weight. However, the present inventor has discovered that this formulation is not as effective as the formulation which comprises the polyacrylate, sodium silicate, water and bentonite.

The glycol is preferably propylene glycol. Although it is also possible that the glycol could also be 1,3-butylene glycol, 1,6-hexylene glycol, ethylene glycol, and dipropylene glycol. It is also possible that the glycol could be replaced with butyl carbitol.

Optionally, the inert liquid vehicle may comprise a mixture of a glycol which is present in an amount of between about 0 to about 60% by weight, and glycerine which is present in an amount of between about 0 to about 70% by weight, wherein the specific gravity of the bentonite is approximately the same as the specific gravity of the invert liquid vehicle. It may also be possible to substitute any of the following compositions for glycerine 1,2,3,4,5,6-hexane hexol, 1,2,3,4 butane tetrol, pentaerythritol and ethylene carbonate.

The suspension agent may comprise a mixture of a polymeric fatty acid ester and another dispersing agent. An example of a preferred polymeric fatty acid ester, e.g., Atkemix Hypermer LP6 sold by ICI. The Atkemix Hypermer LP6 fatty acid ester is preferably combined with another dispersing agent such as Atkemix Hypermer PS2 sold by ICI. Other potential dispersing agents are stearic monoethanamide, N,N'-ethylene bis stearamide, polyacrylic acid, polyacrylate, and aluminum stearate. The suspension agent provides improved wetting, dispersion, stabilization and fluidization which can give rise to a variety of effects which may be used to advantage in many particulate suspensions. The effects of the suspension agent on the liquid suspension of bentonite is a dramatic viscosity reduction, increased stability and increased solids loading, i.e., can attain higher percent by weight bentonite than conventional bentonite suspensions.

Moreover, the liquid slurry of bentonite has a Brookfield viscosity in the range between about 300 to about 20,000 centipose (cps), and more preferably 5,000 to about 10,000 cps.

The glycol-based liquid slurry of bentonite is prepared by initially charging a reactor vessel with between about 0 to about 60% by weight of a propylene glycol and between about 0 to about 70% by weight of glycerine with agitation. During mixing, accurately charge the reactor vessel with a suspension agent comprising between about 0.5 to about 5% by weight of polymeric fatty acid ester or between about 0.5 to about 5% by weight of another dispersing agent. Continue to mix rapidly and slowly charge the reactor vessel with between about 30 to about 40% by weight of a dry bentonite. After all of the bentonite is charged into the vessel, mix for an additional hour.

The liquid slurry of bentonite prepared above is used in treating paper, pulp or board wastewater to improve retention and purification of cellulose fiber suspensions, and clarification of the wastewater. The liquid bentonite is preferably added to the wastewater in a concentration within the range between about 5 ppm to about 500 ppm, more preferably in the range between about 10 ppm to about 200 ppm, as ligand product.

One specific process where the use of a liquid slurry of bentonite has been found to be most useful is in the production of fine paper made from an aqueous cellulosic suspension having a pH in the range between about 6.8 to about 9.0. In this process a cellulosic suspension comprising fibers, a precipitated calcium carbonate filler and a cationic starch strengthening agent, is passed through one or more shear stages, drained and dried to form a sheet. A cationic coagulant is added to the cellulosic suspension in an amount between about 0.001% to about 0.5%, based on the dry weight of the suspension, prior to any of the shear stages. An anionic flocculant is added to the suspension in amount between about 0.001% to about 0.8%, based on the dry weight of the suspension, after the coagulant but before any of the shear stages. And a liquid slurry of bentonite is added to the suspension after at least one of the shear stages.

The following comparative examples were conducted to demonstrate the advantages of the liquid suspension of bentonite according to the present invention verses the conventional dry bentonite preparations and to determine the best formulation of the product.

EXAMPLE 1

A liquid slurry of bentonite was prepared by charging 60% by weight of propylene glycol, 40% by weight of dry bentonite, and 0.5% by weight of Atkemix Hypermer PS2 dispersing agent into a reaction vessel and mixing. A stable liquid slurry of bentonite was observed.

EXAMPLE 2

A liquid slurry of bentonite was prepared by charging 60% by weight of propylene glycol, 40% by weight of dry particulate bentonite, 0.5% by weight of Atkemix Hypermer PS2 dispersing agent, and 1% by weight of Atsuf 595 (i.e., a glycerol monooleate) into a reaction vessel and mixing. A stable liquid slurry of bentonite was observed.

EXAMPLE 3

The below chemical treatment programs were evaluated for their retention and drainage properties as measured by suction drainage (SD), first pass retention (FPR) and first pass ash retention (FPAR). The treatment programs were tested on a paper composition exhibiting the following properties:

pH=5.1

Consistency=1.04%

HB Component=80% TMP, 20% Kraft and 20% Alphatex Clay (Based on Fiber)

TABLE 1

| PROGRAM | DOSAGE Kg/ton | SD 100 ml, sec | FPR | FPAR |
|---|---|---|---|---|
| Dry Bentonite/Liquid PEO | 2.5/0.35 | 68.4 | 65.6 | 50.7 |
| Dry Bentonite/Liquid PEO | 5.0/0.35 | 85.8 | 60.5 | 42.7 |
| Dry Bentonite/Liquid PEO | 2.5/0.75 | 50.4 | 71.7 | 63.2 |
| Dry Bentonite/Liquid PEO | 2.5/0.75 | 59.7 | 66.5 | 53.8 |
| Liquid Bentonite/Liquid PEO | 1.0/0.35 | 80.3 | 59.9 | 42.3 |
| Liquid Bentonite/Liquid PEO | 1.0/0.75 | 62.2 | 64.0 | 47.9 |
| Liquid Bentonite/Liquid PEO | 2.5/0.75 | 63.7 | 63.1 | 47.7 |
| Liquid Bentonite/Liquid PEO | 2.5/1.00 | 70.6 | 65.4 | 50.5 |
| Liquid Bentonite/Liquid PEO | 5.0/0.35 | 66.0 | 71.1 | 61.1 |
| Blank | | 128 | 51.8 | 26.1 |

Notes:
Liquid Bentonite was formed from 52% tap water, 25% calcium salt of naphthalene sulfonate condensate polymer and 23% dry bentonite. Liquid PEO was formed from 30% polyethylene oxide particulate, 28% glycol, 35.4% glycerine, 5% aluminum chlorhydrol and 0.6% of stability additives.

EXAMPLES 4–14

The following examples of liquid bentonite were prepared by heating water to 85° C., adding sodium silicate which has previously been dissolved in cold water, adding a polymer composition, and slowly blending in dry bentonite.

TABLE 2

| COMPONENT | 4 | 5 | 6 | 7 | 8 | 9 | 10 |
|---|---|---|---|---|---|---|---|
| $H_2O$ | 50 | 50 | 25 | 25 | 25 | 25 | 25 |
| Sodium Silicate | 2 | 2 | 2 | 2 | 2 | 2 | 2 |
| Calcium Naphthalene Sulfonate | 25 | 25 | — | — | — | — | — |
| Polyacrylate | — | — | 50 | — | — | — | — |
| Sodium Polyacrylate (8,000 MW) | — | — | — | 50 | — | — | — |
| Polymaleic Acid | — | — | — | — | 50 | — | — |
| Na Salt of Acrylic Acid/Maleic Acid* | — | — | — | — | — | 50 | — |
| Na Salt of Acrylic Acid/Maleic Acid** | | — | — | — | — | — | 50 |
| Na Salt of Maleic Acid/Olefin*** | — | — | — | — | — | — | — |
| Modified Sodium Polyacrylic Acid | — | — | — | — | — | — | — |
| Sodium Polyacrylate (1,200 MW) | — | — | — | — | — | — | — |
| Sodium Polyacrylate (15,000 MW) | — | — | — | — | — | — | — |
| Chemically Modified Bentonite | 23 | 23 | 23 | 23 | 23 | 23 | 23 |

| COMPONENT | 11 | 12 | 13 | 14 |
|---|---|---|---|---|
| $H_2O$ | 25 | 25 | 25 | 25 |
| Sodium Silicate | 2 | 2 | 2 | 2 |
| Calcium Naphthalene Sulfonate | — | — | — | — |
| Polyacrylate | — | — | — | — |
| Sodium Polyacrylate (8,000 MW) | — | — | — | — |
| Polymaleic Acid | — | — | — | — |
| Na Salt of Acrylic Acid/Maleic Acid* | — | — | — | — |
| Na Salt of Acrylic Acid/Maleic Acid** | — | — | — | — |
| Na Salt of Maleic Acid/Olefin*** | 50 | — | — | — |
| Modified Sodium Polyacrylic Acid | — | 50 | — | — |
| Sodium Polyacrylate (1,200 MW) | — | — | 50 | — |
| Sodium Polyacrylate (15,000 MW) | — | — | — | 50 |
| Chemically Modified Bentonite | 23 | 23 | 23 | 23 |

*A sodium salt copolymer of acrylic acid and maleic acid with an active weight % of 40, a molar mass weight average of 70,000 and a molar mass number average of 9,000, a K-value of 60 and a pH of 8.
**A sodium salt copolymer of acrylic acid and maleic acid with an active weight % of 40, a molar mass weight average of 50,000 and a molar mass number average of 6,500, a K-value of 50 and a pH of 8.
***A sodium salt copolymer of maleic acid and an olefin with an active weight % of 25, a molar mass weight average of 12,000 and a molar mass number average of 2,500, a K-value of 40 and a pH of 10.5.

The best formulations of liquid bentonite were observed in samples 9 and 10 which comprised 25% water, 2% sodium silicate, 50% of a sodium salt copolymer of acrylic acid and maleic acid and 23% bentonite.

EXAMPLES 15–17

Applicant has created the below formulations of liquid bentonite which exhibit satisfactory viscosity and stability.

TABLE 3

| COMPONENT | 15 | 16 | 17 |
|---|---|---|---|
| $H_2O$ | 50 | 25 | 25 |
| Sodium Silicate | 2 | 2 | 2 |
| Calcium Naphthalene Sulfonate | 25 | — | — |

TABLE 3-continued

| COMPONENT | 15 | 16 | 17 |
|---|---|---|---|
| Condensate Polymer | | | |
| Na Salt of Acrylic Acid/Maleic Acid* | — | 48 | — |
| Na Salt of Acrylic Acid/Maleic Acid** | — | — | 48 |
| Chemically Modified Bentonite | 23 | 25 | 25 |

*A sodium salt copolymer of acrylic acid and maleic acid with an active weight % of 40, a molar mass weight average of 70,000 and a molar mass number average of 9,000, a K-value of 60 and a pH of 8.
**A sodium salt copolymer of acrylic acid and maleic acid with an active weight % of 40, a molar mass weight average of 50,000 and a molar mass number average of 6,500, a K-value of 50 and a pH of 8.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A process for preparing a liquid slurry of bentonite which comprises the steps of:

charging a reactor vessel with between about 25 to about 75% by weight of water;

heating said water to a temperature in the range between about 50° C. to about 95° C.;

charging said reactor vessel with between about 0.1 about 10% by weight of sodium salt of silicic acid;

charging said reactor vessel with between about 15 to about 35% by weight of bentonite; and charging said reactor vessel with between about 10 to about 30% by weight of a polyacrylate.

2. The process according to claim 1 further comprising the step of charging said reaction vessel with between about 10 to about 30% by weight of a sulfonate.

3. The process according to claim 2 wherein said sulfonate is calcium naphthalene sulfonate condensate polymer.

4. The process according to claim 1 wherein said polyacrylate is a copolymer of acrylic acid and maleic acid, and salts thereof.

5. The process according to claim 1 wherein said polyacrylate is sodium polyacrylate.

6. The process according to claim 1 wherein said polyacrylate has a molecular weight in the range between about 5,000 to about 250,000.

7. The process according to claim 6 wherein said polyacrylate has a molecular weight in the range between about 8,000 to about 100,000.

8. The process according to claim 7 wherein said polyacrylate has a molecular weight in the range between about 10,000 to about 100,000.

9. The process according to claim 1 wherein said bentonite is a chemically modified bentonite.

* * * * *